US007365692B1

(12) United States Patent
Su et al.

(10) Patent No.: US 7,365,692 B1
(45) Date of Patent: Apr. 29, 2008

(54) WIDEBAND OMNIDIRECTIONAL ANTENNA FOR PLUG AND PLAY DEVICE

(75) Inventors: Saou-Wen Su, Taipei (TW); Horng-Ming Tai, Taipei (TW)

(73) Assignee: Lite-On Technology Corp., Neihu, Taipei (TW)

( * ) Notice: Subject to any disclaimer, the term of this patent is extended or adjusted under 35 U.S.C. 154(b) by 0 days.

(21) Appl. No.: 11/670,428

(22) Filed: Feb. 2, 2007

(30) Foreign Application Priority Data

Oct. 11, 2006 (TW) ..... 95137404 A

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS

2001/0015705 A1* 8/2001 Scordilis ..... 343/845
2005/0024268 A1* 2/2005 McKinzie et al. ... 343/700 MS
2005/0062670 A1 3/2005 Suh et al.
2005/0243009 A1 11/2005 Wong et al.
2007/0194997 A1* 8/2007 Nakanishi et al. ..... 343/702

* cited by examiner

*Primary Examiner*—Trinh Dinh
*Assistant Examiner*—Dieu Hien T Duong
(74) *Attorney, Agent, or Firm*—Winston Hsu

(57) ABSTRACT

A wideband omnidirectional antenna for a plug and play device includes a system ground plane, a radiating element, a feeding element. The radiating element is installed above an edge of the system ground plane and comprises a first sub-radiating element and a second sub-radiating element. The first sub-radiating element is parallel to the system ground plane. The second sub-radiating element is electronically connected to an edge of the first sub-radiating element in a foldable manner. The second sub-radiating element is approximately perpendicular to the first sub-radiating element and extends in an upright direction above the system ground plane when in use condition, and is approximately parallel to the first sub-radiating element and extends horizontally above the system ground plane when not in use condition. The feeding element is electronically connected to a signal source and is used for transmitting signals outputted from the signal source to the radiating element.

8 Claims, 13 Drawing Sheets

WIDEBAND OMNIDIRECTIONAL ANTENNA FOR PLUG AND PLAY DEVICE

BACKGROUND OF THE INVENTION

1. Field of the Invention

The present invention relates to a wideband omnidirectional antenna, and more particularly, to a wideband omnidirectional antenna for a plug and play device.

2. Description of the Prior Art

With a rapid growth of demands for short-distance wireless transmission, massive provision of wireless local area network and diversification of personal mobile communication products, data throughput and transmission rate of wireless communication have been simultaneously increasing. Whereas this, the US Federal Communications Commission (FCC) authorizes ultra-wideband (UWB) transmission technology eligible for commercial communications system in February 2002. The ultra-wideband transmission technology is developed as a high transmission rate (data rate over 100 Mbs), low power (less than −41 dBm/MHz), and short-distance (effective radius smaller than 10 meters) communications system extremely suitable for transmitting multimedia video data of 400 Mbs, which allows wirelessly sharing DVD-quality recorded programs in home environment. In addition, the Institute of Electrical and Electronics Engineers (IEEE) develops a standard of wireless personal area network, IEEE 802.15.3 WPAN, including advantages of high transmission rate and low power for satisfying mobile communications consumer products having high definition (HD) applications.

Among architecture of the prior art wideband antennas, a metal planar antenna has most practical value. In general, the metal planar antenna has a larger size and is installed above the center of a large metal ground plane, suitable for the use of a wideband access-point antenna. US patent, publication No. 20050062670, discloses various types of planar wideband antennas applied to wideband communications (3.1-10.6 GHz). However, in practice, the sizes of the antennas are too large to be installed on a wireless plug and play device, such as universal serial bus (USB) devices. In addition, the planar wideband antennas have shortcomings of instability with respect to radiation patterns, where omnidirectional properties become worse as operating frequencies increase. In order to improve such problem, US patent, publication No. 20050243009, discloses an omnidirectional broadband monopole antenna, which bends a metal plate several times for controlling radiation patterns of two horizontal directions, so as to satisfy requirements of a wideband omnidirectional antenna. However, such omnidirectional broadband monopole antenna is also installed above the center of a large metal ground plane, which is not suitable for the plug and play devices.

Therefore, how to design an antenna, suitable for wireless plug and play devices and wideband applications, satisfying requirements of omnidirectional radiation patterns, and having simple, easy, and small-sized architecture, is a major objective for those skilled in the art.

SUMMARY OF THE INVENTION

It is therefore an object of the present invention to provide a wideband omnidirectional antenna for a plug and play device.

The present invention discloses a wideband omnidirectional antenna for a plug and play device. The wideband omnidirectional antenna comprises a system ground plane, a radiating element, a feeding element. The radiating element is installed above an edge of the system ground plane and comprises a first sub-radiating element and a second sub-radiating element. The first sub-radiating element is parallel to the system ground plane. The second sub-radiating element is electronically connected to an edge of the first sub-radiating element in a foldable manner. Thereby, the second sub-radiating element is approximately perpendicular to the first sub-radiating element and extends in an upright direction above the system ground plane when in use condition, and is approximately parallel to the first sub-radiating element and extends horizontally above the system ground plane when not in use condition. The feeding element is electronically connected to a signal source and is used for transmitting signals outputted from the signal source to the radiating element.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
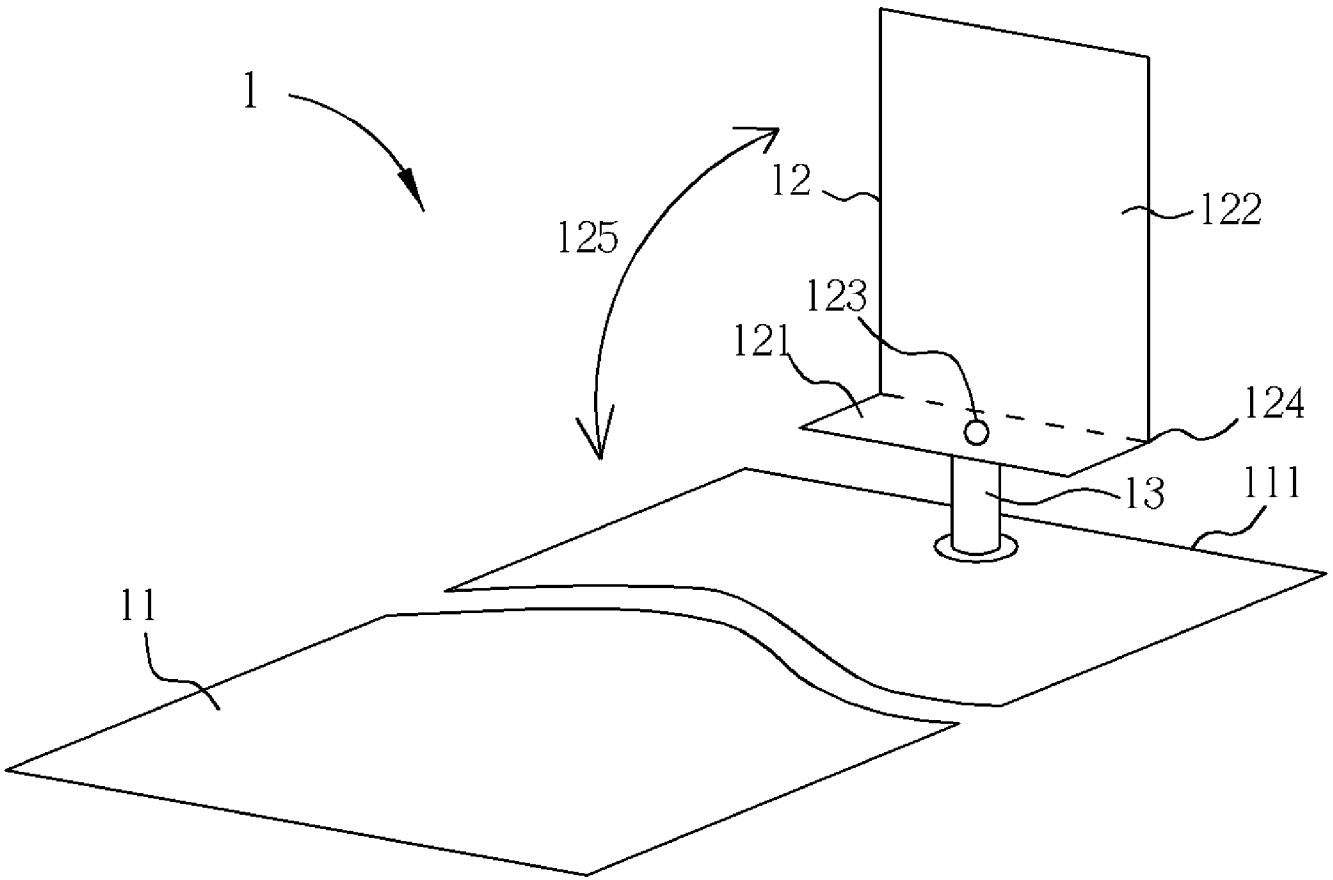
FIG. 1 is a schematic diagram of a wideband omnidirectional antenna according to an embodiment of the present invention.

Please refer to FIG. 1, which is a schematic diagram of a wideband omnidirectional antenna 1 for a plug and play device in accordance with an embodiment of the present invention. The wideband omnidirectional antenna 1 includes a system ground plane 11, a radiating element 12, a feeding element 13. The system ground plane 11 is approximately rectangular and used for forming grounding of the wideband omnidirectional antenna 1. The radiating element 12 is installed above an edge 111 of the system ground plane 11 and operates as a main radiating device of the wideband omnidirectional antenna 1. The radiating element 12 includes a first sub-radiating element 121 and a second sub-radiating element 122. The first sub-radiating element 121 is parallel to the system ground plane 11, where a feeding point 123 set on the first sub-radiating element 121 is electronically connected to the feeding element 13 and used for receiving signals of the feeding element 13. The second sub-radiating element 122 is electronically connected to an edge of the first sub-radiating element 121 in a foldable manner (along an arrow 125). When the wideband omnidirectional antenna 1 receives or transmits signals, the second sub-radiating element 122 is unfolded along the arrow 125, so that the second sub-radiating element 122 becomes perpendicular to the first sub-radiating element 121 and extends in an upright direction above the system ground plane 11. When the wideband omnidirectional antenna 1 is not in use condition, the second sub-radiating element 122 is closed, so that the second sub-radiating element 122 becomes parallel to the first sub-radiating element 121, and extends horizontally above the system ground plane 11. The feeding element 13 is electronically connected to a signal source and used for transmitting signals outputted from the signal source to the first sub-radiating element 121.

Figure 2:
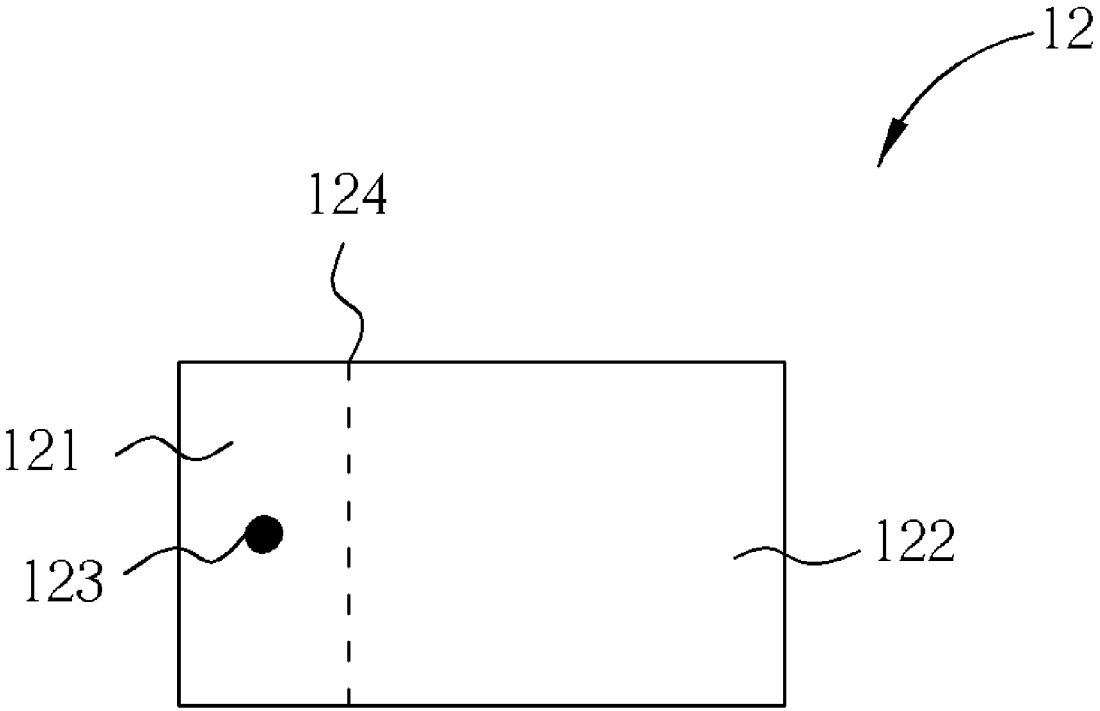
FIG. 2 is a schematic diagram of a unfolded plane of the radiating element of the wideband omnidirectional antenna shown in FIG. 1.

Therefore, when the plug and play device does not uses the wideband omnidirectional antenna 1 for receiving or transmitting signals, the second sub-radiating element 122 can be concealed, so as to reduce the height of the wideband omnidirectional antenna 1 and space. When the plug and play device uses the wideband omnidirectional antenna 1 for receiving or transmitting signals, the second sub-radiating element 122 can be unfolded, so that the radiating element 12 forms a shape of "L". Preferably, the first sub-radiating element 121 and the second sub-radiating element 122 are formed by stamping or cutting a metal plate, or formed on a single flexible circuit board by printing or etching. For example, please refer to FIG. 2, which is a schematic diagram of the unfolded radiating element 12. As shown in FIG. 2, the radiating element 12 is a rectangular metal plate or printed on a single flexible circuit board, and is separated along a line 124 to form the first sub-radiating element 121 and the second sub-radiating element 122.

Figure 3:
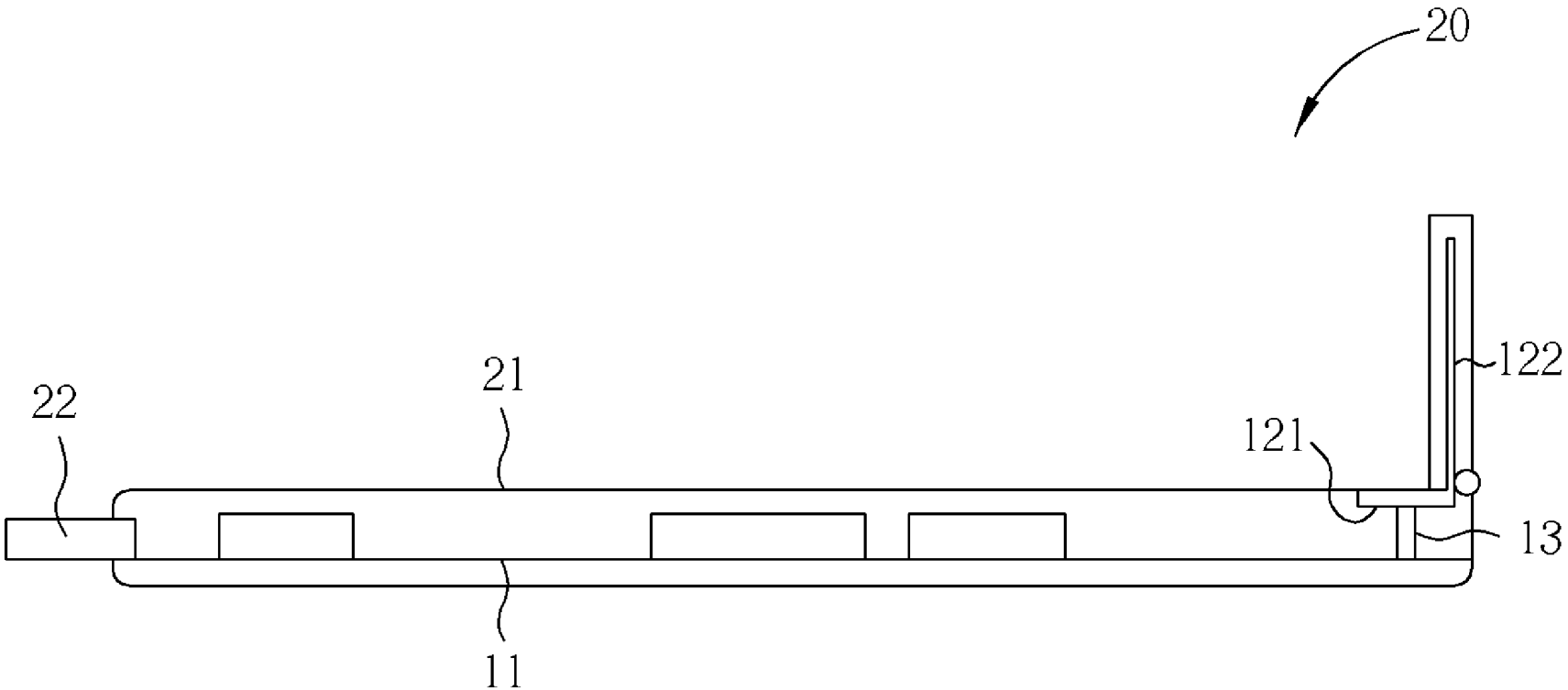
FIG. 3 is a three-dimensional schematic diagram of a plug and play device adopting the wideband omnidirectional antenna shown in FIG. 1 when in use condition.
Figure 4:
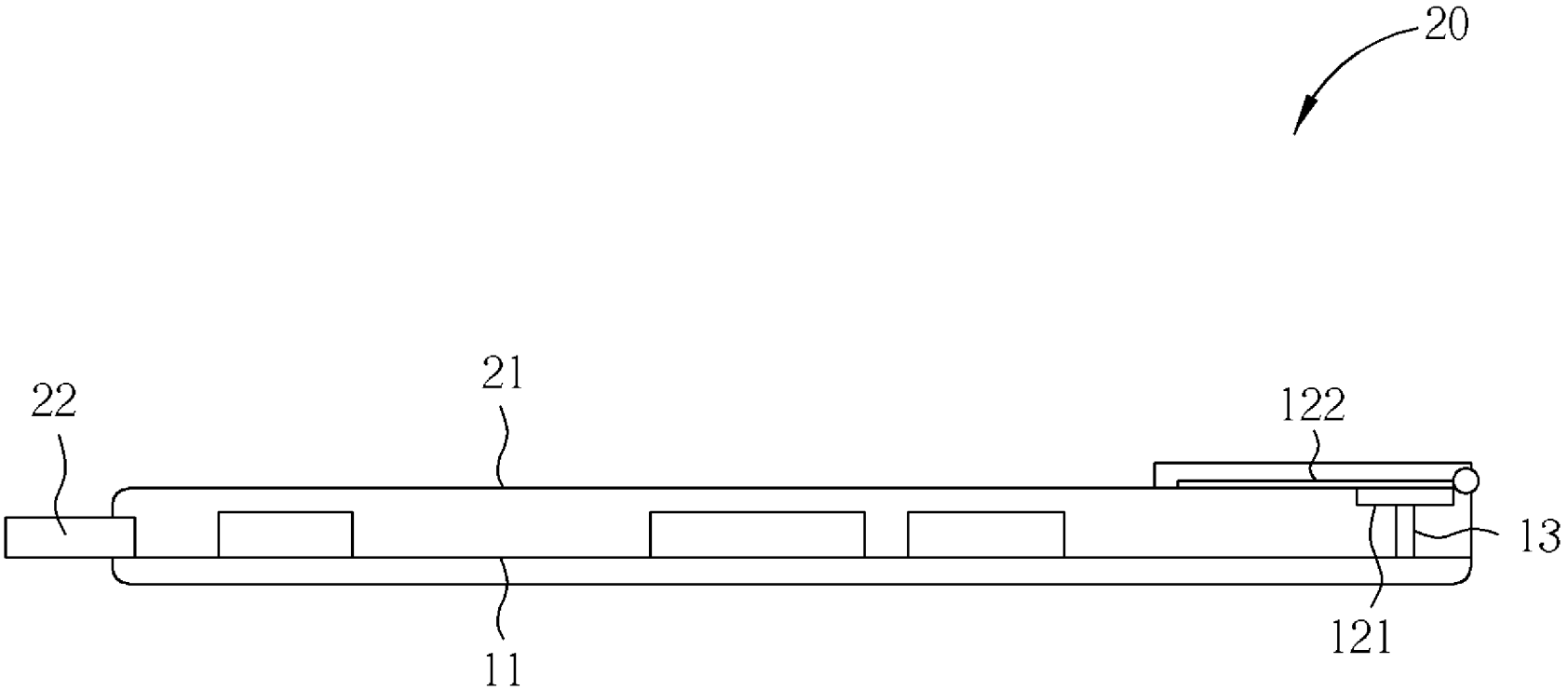
FIG. 4 is a three-dimensional schematic diagram of a plug and play device adopting the wideband omnidirectional antenna shown in FIG. 1 when not in use condition.

In short, the present invention utilizes the foldable radiating element 12 to reduce the size of the wideband omnidirectional antenna 1 when not in use condition, so as to apply to wireless plug and play devices. For instance, please refer to FIG. 3 and FIG. 4. FIG. 3 and FIG. 4 are three-dimensional schematic diagrams of a plug and play device 20 adopting the wideband omnidirectional antenna 1 in use condition and in standby condition. The plug and play device 20 includes a housing 21, a universal serial bus connector 22, and other related processing circuitries, such as amplifiers, wireless signal processing modules, memories. The wideband omnidirectional antenna 1 is installed inside the housing 21. When the antenna is in operation, users can unfold the second radiating element 122 as shown in FIG. 3. When the antenna is not in operation, the second radiating element 122 can be concealed as shown in FIG. 4.

Figure 5:
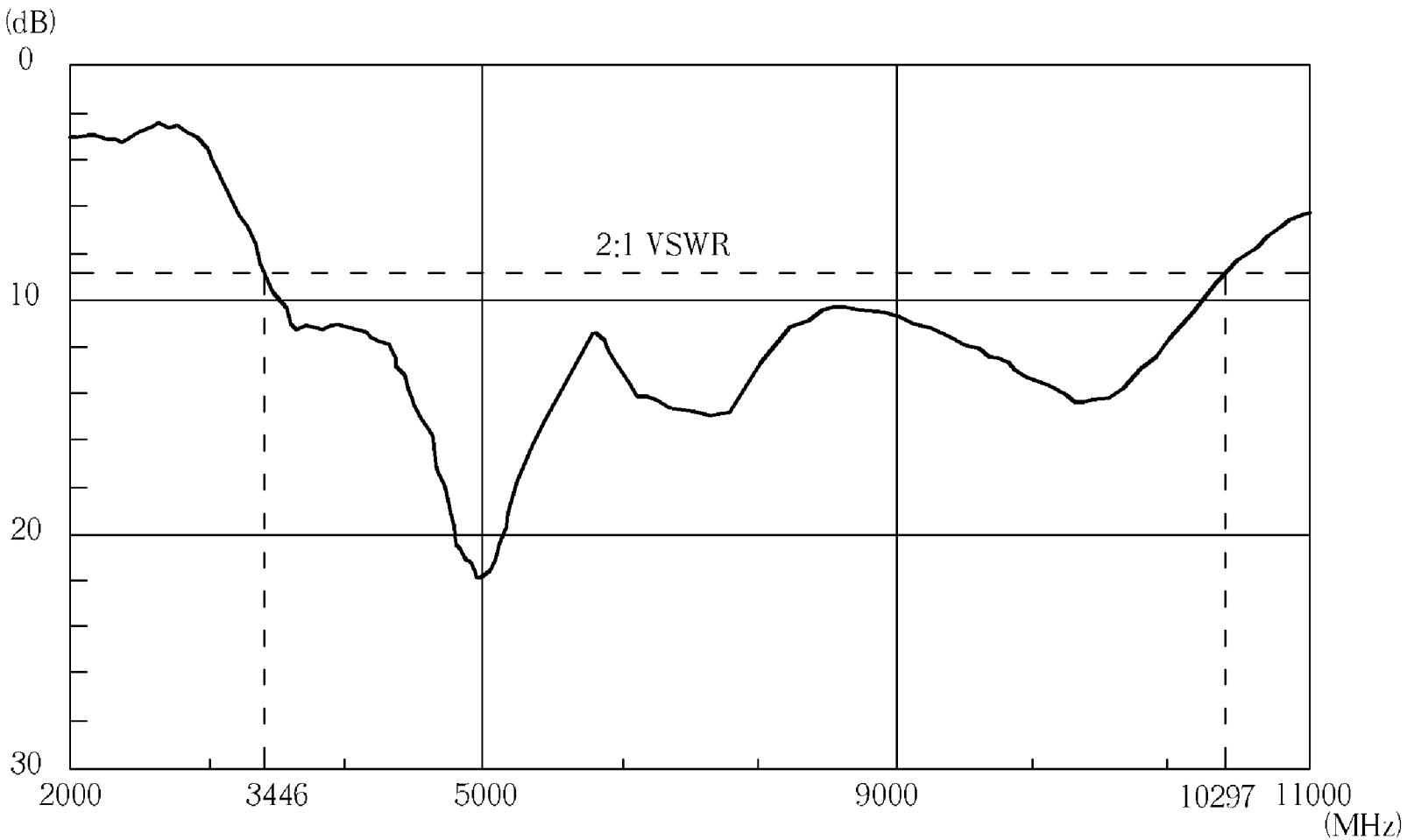
FIG. 5 is a measurement result of return loss of the wideband omnidirectional antenna shown in FIG. 1.
Figure 6:
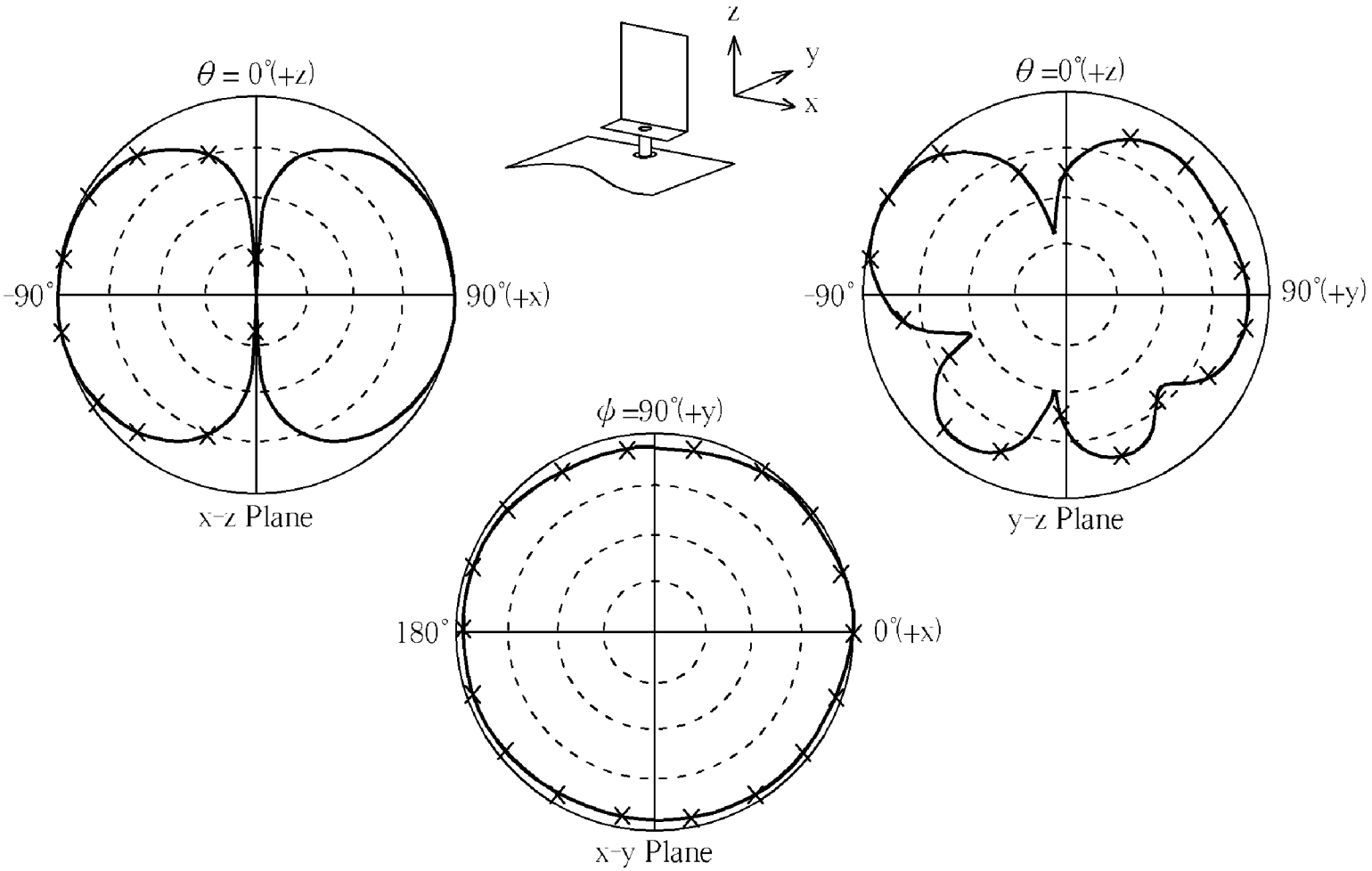
FIG. 6 is a radiation pattern diagram of the wideband omnidirectional antenna shown in FIG. 1 operating at 500 MHz.
Figure 7:
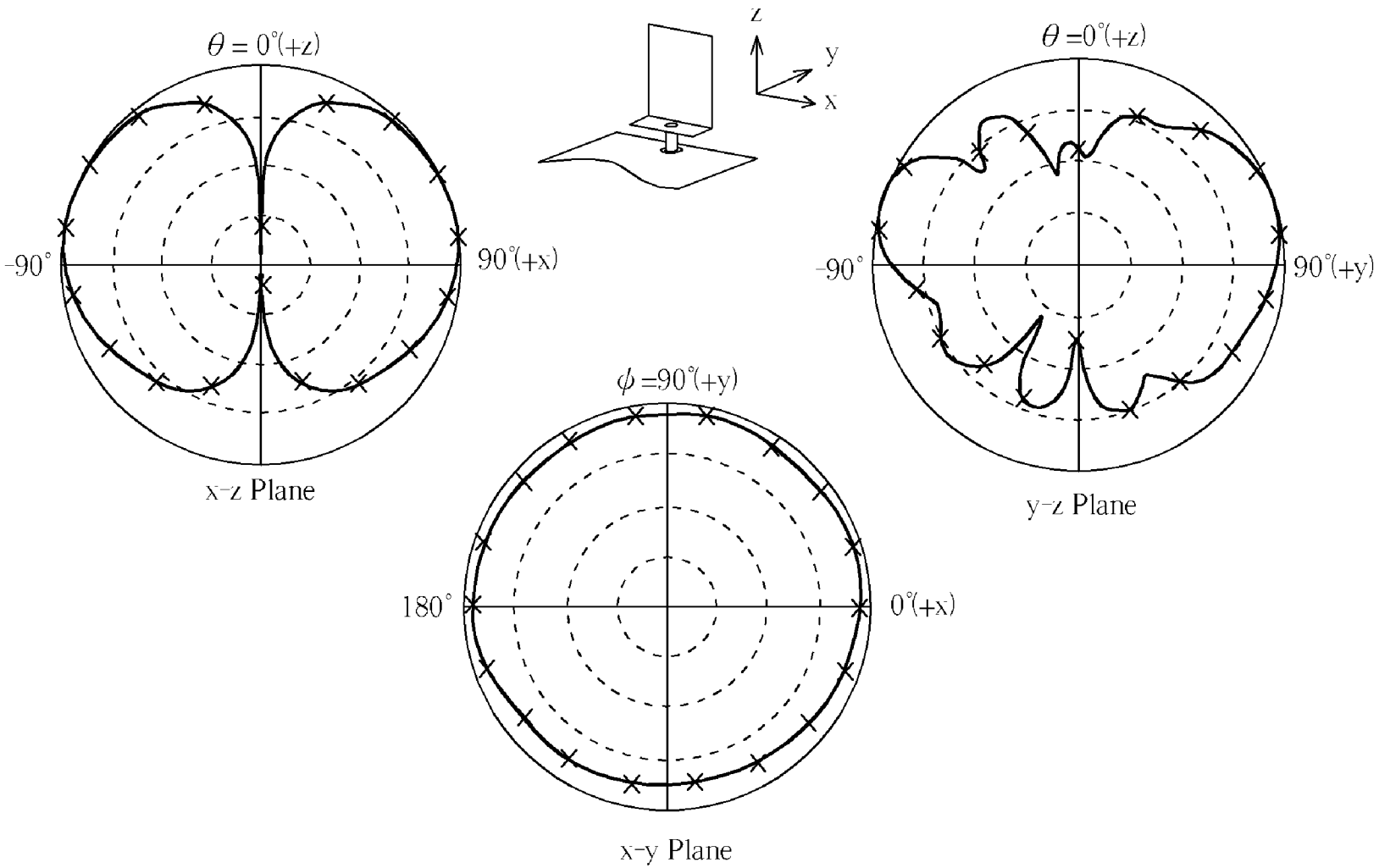
FIG. 7 is a radiation pattern diagram of the wideband omnidirectional antenna shown in FIG. 1 operating at 700 MHz.
Figure 8:
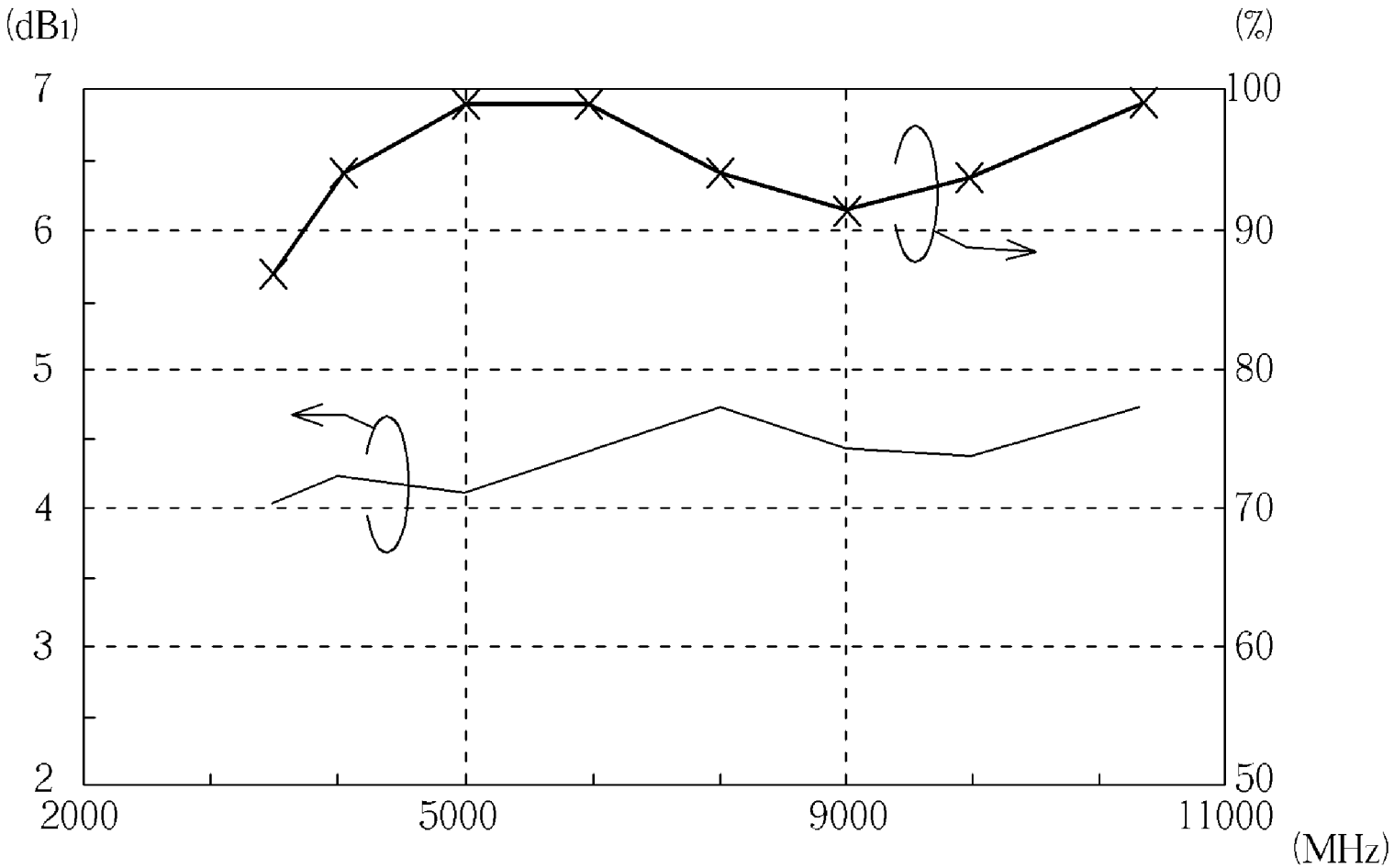
FIG. 8 is a diagram of antenna gain and radiation efficiency of the wideband omnidirectional antenna shown in FIG. 1.

Certainly, those skilled in the art can adjust the size of the wideband omnidirectional antenna 1 according to demanded operating frequencies. For example, when applying to an ultra-wideband application, sizes of each element of the wideband omnidirectional antenna 1 can be set as follows: the length and width of the system ground plane 11 are 65 mm and 20 mm, the length and width of the first radiating element 121 are 9 mm and 4 mm, the length and width of the first radiating element 122 are 12 mm and 9 mm, and the height of the feeding element 13 is 3 mm. Under this circumstance, related experiment results of the wideband omnidirectional antenna 1 are shown from FIG. 5 to FIG. 8. FIG. 5 shows a measurement result of return loss of the wideband omnidirectional antenna 1, FIG. 6 is a radiation pattern diagram of the wideband omnidirectional antenna 1 operating at 500 MHz, FIG. 7 is a radiation pattern diagram of the wideband omnidirectional antenna 1 operating at 700 MHz, and FIG. 8 is a diagram of antenna gain and radiation efficiency of the wideband omnidirectional antenna 1. As shown in FIG. 5, the wideband omnidirectional antenna 1 can achieve an operating bandwidth of 6851 MHz (3446~10297 MHz), defined by 2:1 VSWR (voltage standing wave ratio) return loss. In FIG. 6 and FIG. 7, each radiation pattern is normalized with respect to peak antenna gain. As shown in FIG. 6 and FIG. 7, the wideband omnidirectional antenna 1 has good omnidirectional radiation patterns. In FIG. 8, the upper curve represents radiation efficiency, while the lower curve represents antenna gain. It can be seen that in the range of operating frequency, the antenna gain is roughly between 4.0~4.7 dBi while the radiation efficiency is greater than 86%, which satisfies requirements for a wideband antenna.

In general, a traditional wideband planar antenna has a large size, and is installed above the center of a large metal ground plane, so that the traditional wideband planar antenna is not suitable for the wireless plug and play devices. In the present invention, the omnidirectional wideband antenna is about 1 cm wide and 1.5 cm high (when in use condition), and can be installed above an edge of a small metal ground plane. Controlling the distance and size of the radiating element parallel to the system ground plane can easily obtain expected wideband impedance bandwidth with return loss smaller than 9.6 dB. In addition, the width of the omnidirectional wideband antenna is approximately ¼ the wavelength of the highest frequency of the impedance bandwidth, so that the omnidirectional wideband antenna can perform an omnidirectional horizontal radiation pattern at all frequencies within the operating bandwidth.

Figure 9:
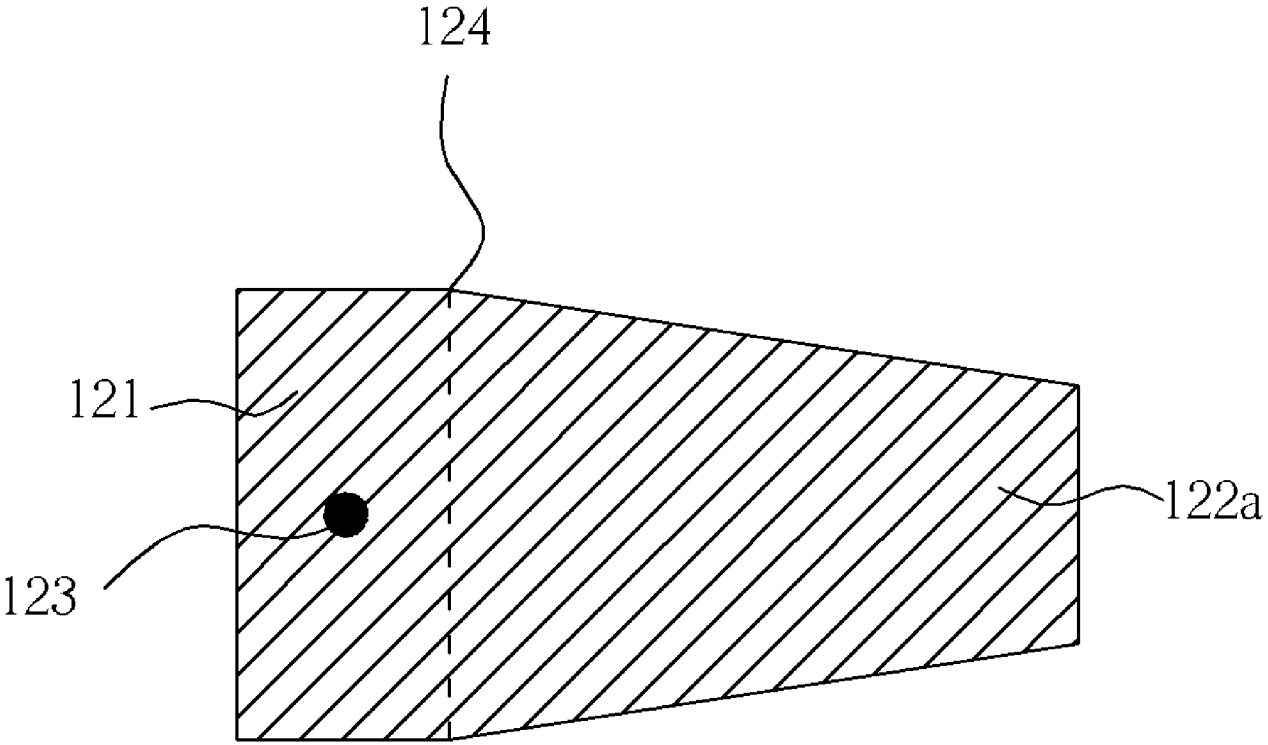
FIG. 9 to FIG. 11 are schematic diagrams of second radiating elements of the wideband omnidirectional antenna shown in FIG. 1 according to embodiments of the present invention.
Figure 10:
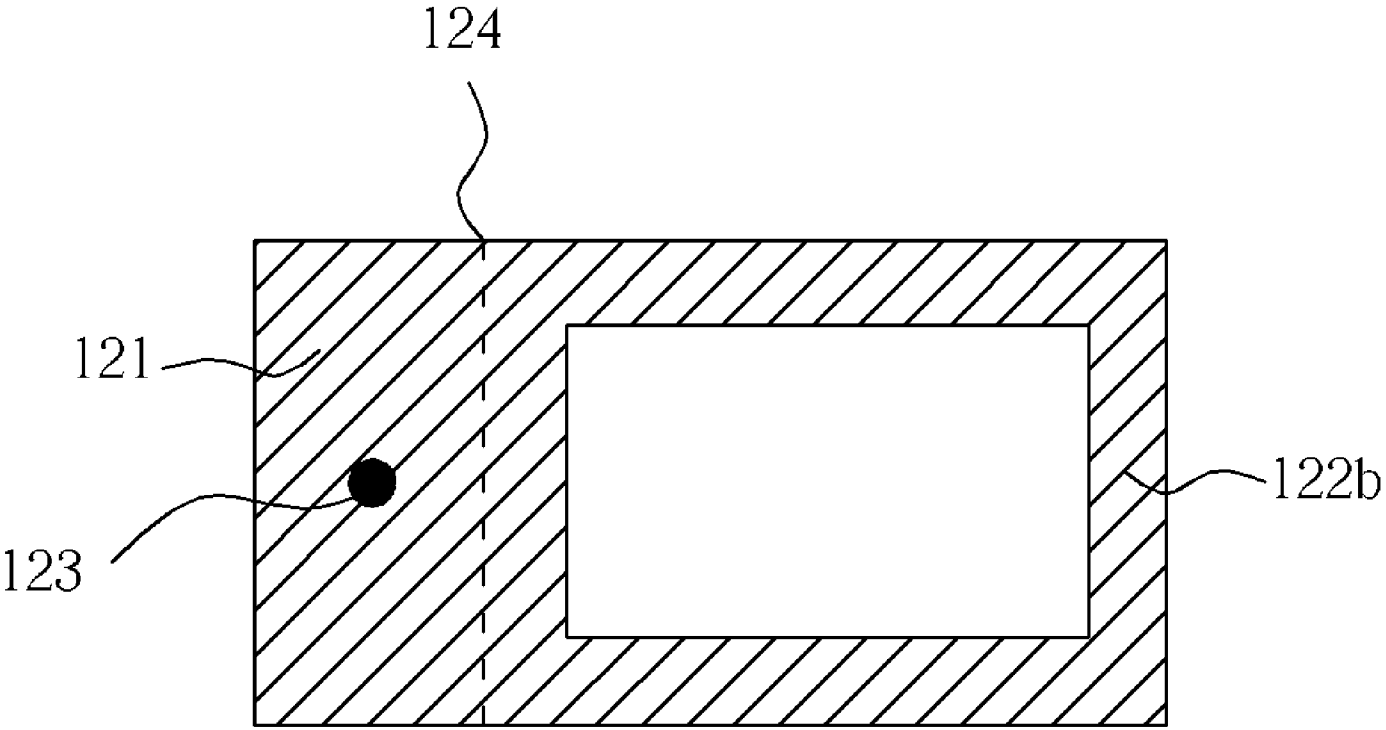
Figure 11:
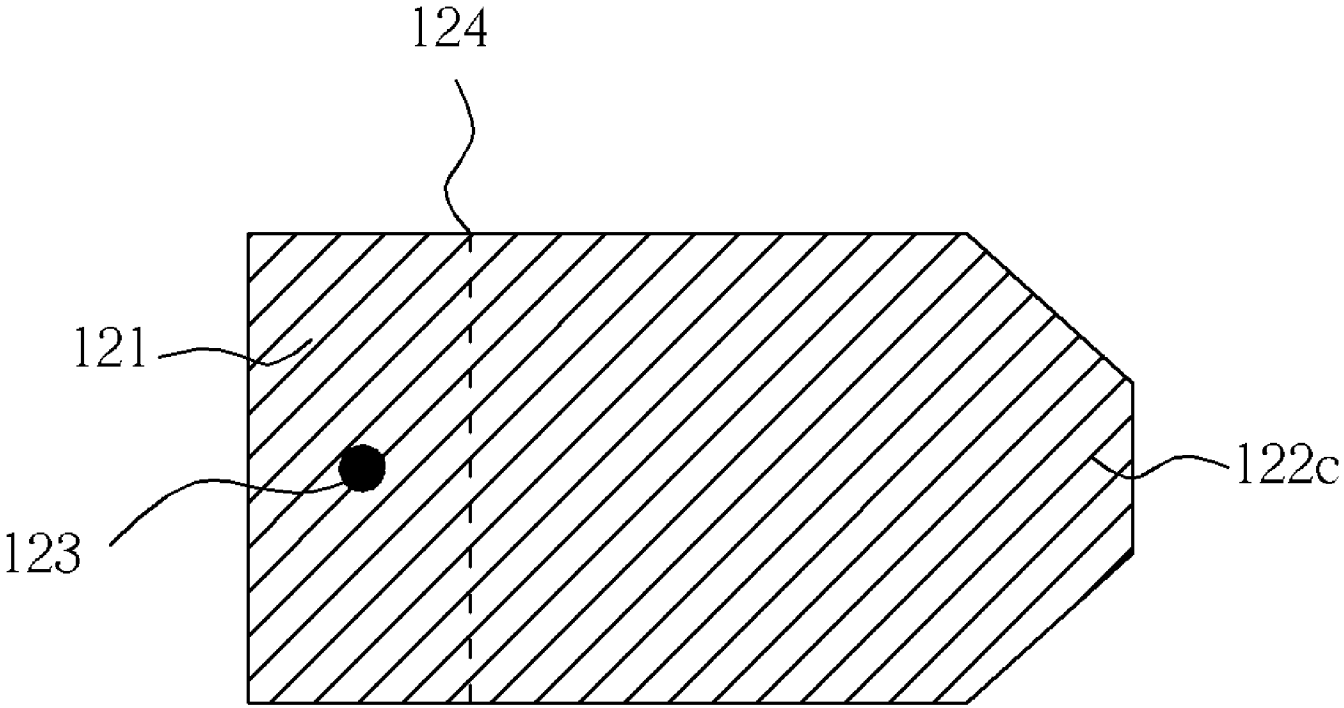
Figure 12:
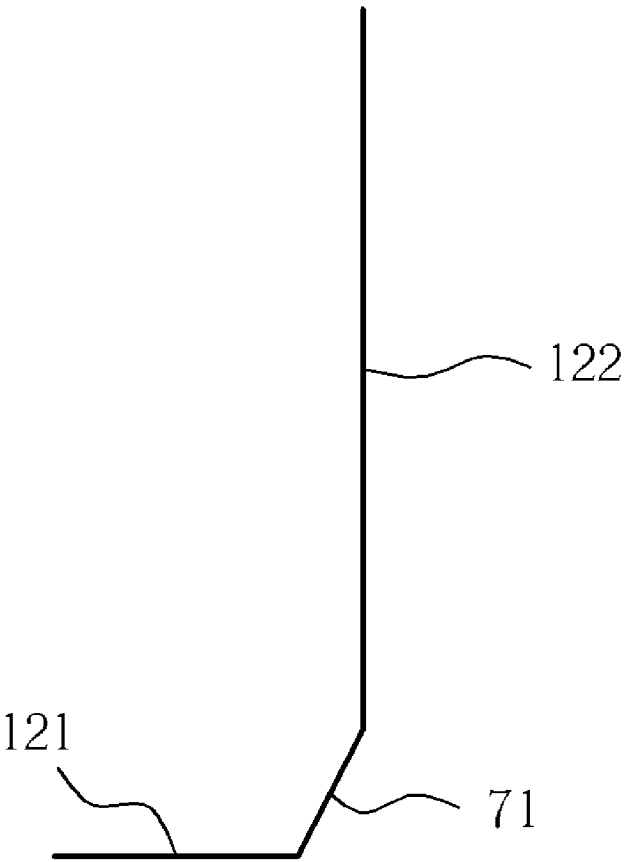
FIG. 12 and FIG. 13 are schematic diagrams of the radiating element of the wideband omnidirectional antenna shown in FIG. 1 with different bending angles.
Figure 13:
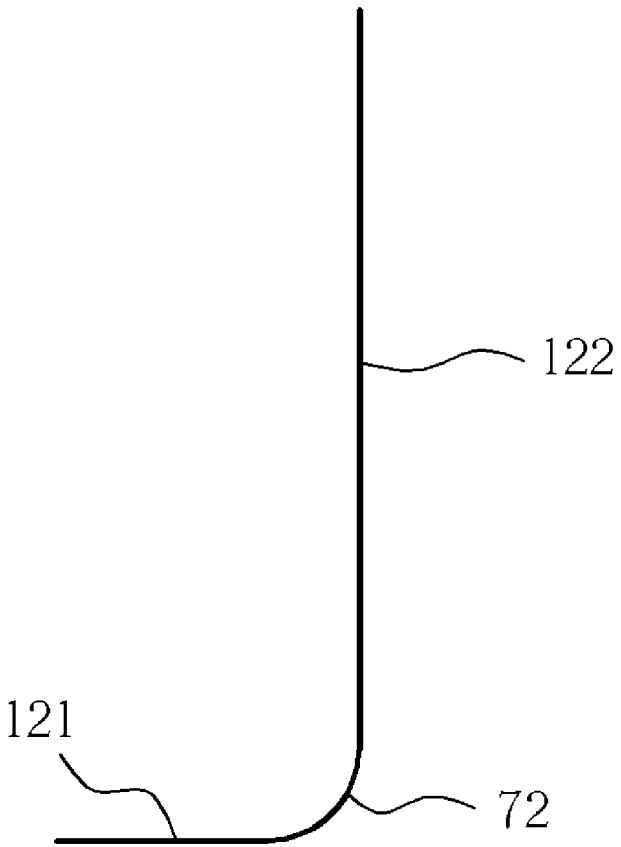

Note that, the shape of each element mentioned above is a preferable embodiment of the present invention, and those skilled in the art can make modifications if necessary. For example, FIG. 9 to FIG. 11 illustrate schematic diagrams of different shapes of second radiating elements 122*a*, 122*b*, and 122*c*. FIG. 12 and FIG. 13 illustrate schematic diagrams of the radiating element 12 with bending angles 71, 72.

In summary, the present invention omnidirectional wideband antenna forms an L-shaped radiating element by bending a metal plate or a flexible circuit board, and is installed above the edge of the system ground plane of the wireless plug and play device. The horizontal radiation pattern of the omnidirectional wideband antenna provides the omni-directionality at all frequencies within the operating bandwidth. Since the shape of the present invention omnidirectional wideband antenna is light and handy, the omnidirectional wideband antenna maintains its appearance when in use condition, and is easily stored inside a clamshell-like housing or mechanism when not in use condition. Therefore, the present invention omnidirectional wideband antenna easily meets various business requirements and conforms to the aim of attractive appearance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wideband omnidirectional antenna for a plug and play device comprising:

a system ground plane;

a radiating element installed above an edge of the system ground plane comprising:

a first sub-radiating element parallel to the surface of the system ground plane; and a second sub-radiating element electronically connected to an edge of the first sub-radiating element in a foldable manner, wherein the second sub-radiating element is approximately perpendicular to the first sub-radiating element and extends in an upright direction directly above the system ground plane when in use condition, and is approximately parallel to the first sub-radiating element and extends horizontally above the system ground plane when not in use condition; and a feeding element electronically connected to a signal source and disposed directly above the surface of the system ground plane for transmitting signals outputted from the signal source to the radiating element.

2. The wideband omnidirectional antenna of claim 1, wherein the system ground plane is approximately rectangular.

3. The wideband omnidirectional antenna of claim 1, wherein the first sub-radiating element comprises a feeding point electronically connected to the feeding element.

4. The wideband omnidirectional antenna of claim 1, wherein the radiating element is formed by stamping or cutting a metal plate.

5. The wideband omnidirectional antenna of claim 1, wherein the radiating element is formed on a single flexible circuit board by printing or etching.

6. The wideband omnidirectional antenna of claim 1, wherein the second radiating element is formed as rectangular, trapezoid, circular, or polygonal plane.

7. The wideband omnidirectional antenna of claim 1, wherein the second radiating element comprises at least one bending.

8. The wideband omnidirectional antenna of claim 1, wherein the plug and play device conforms to a transmission specification of universal serial bus (USB).

* * * * *